US008251072B1

(12) United States Patent
Zepp

(10) Patent No.: US 8,251,072 B1
(45) Date of Patent: Aug. 28, 2012

(54) ONE SHOT CIGARETTE SYSTEM

(76) Inventor: Scott D. Zepp, Tampa, FL (US)

( * ) Notice: Subject to any disclaimer, the term of this patent is extended or adjusted under 35 U.S.C. 154(b) by 574 days.

(21) Appl. No.: 12/319,787

(22) Filed: Jan. 12, 2009

(51) Int. Cl.
*A24B 1/04* (2006.01)

(52) U.S. Cl. ..... 131/361; 131/360; 131/191; 206/242

(58) Field of Classification Search ..... 131/360, 131/191, 347, 361; D27/163; 206/242
See application file for complete search history.

(56) References Cited

U.S. PATENT DOCUMENTS 3,752,166 A * 8/1973 Lyon et al. ..... 131/340
4,903,714 A 2/1990 Barnes
4,984,588 A 1/1991 Stewart
5,016,656 A * 5/1991 McMurtrie ..... 131/364
5,794,771 A * 8/1998 Krawec et al. ..... 206/223
6,883,523 B2 4/2005 Dante
2003/0075193 A1* 4/2003 Li et al. ..... 131/364
2003/0159704 A1* 8/2003 Cibort et al. ..... 131/360
2008/0053466 A1* 3/2008 Nathanson ..... 131/191
2008/0216847 A1* 9/2008 Demmer et al. ..... 131/70

* cited by examiner

*Primary Examiner* — Richard Crispino
*Assistant Examiner* — Dionne Walls Mayes

(57) ABSTRACT

A wrapper is fabricated of a biodegradable burnable material. The wrapper is in a generally cylindrical configuration. The wrapper has front and rear ends. In this manner a major chamber is formed. A bowl is fabricated of a biodegradable burnable material. The bowl has a peripheral edge. The bowl is attached to the wrapper adjacent to the front end of the wrapper. The bowl forms a minor chamber within the major chamber. The bowl extends interiorly of the wrapper. A quantity of smokable material is inserted into the bowl. In this manner the smokable material is lit and smoked.

1 Claim, 2 Drawing Sheets

FIG 1
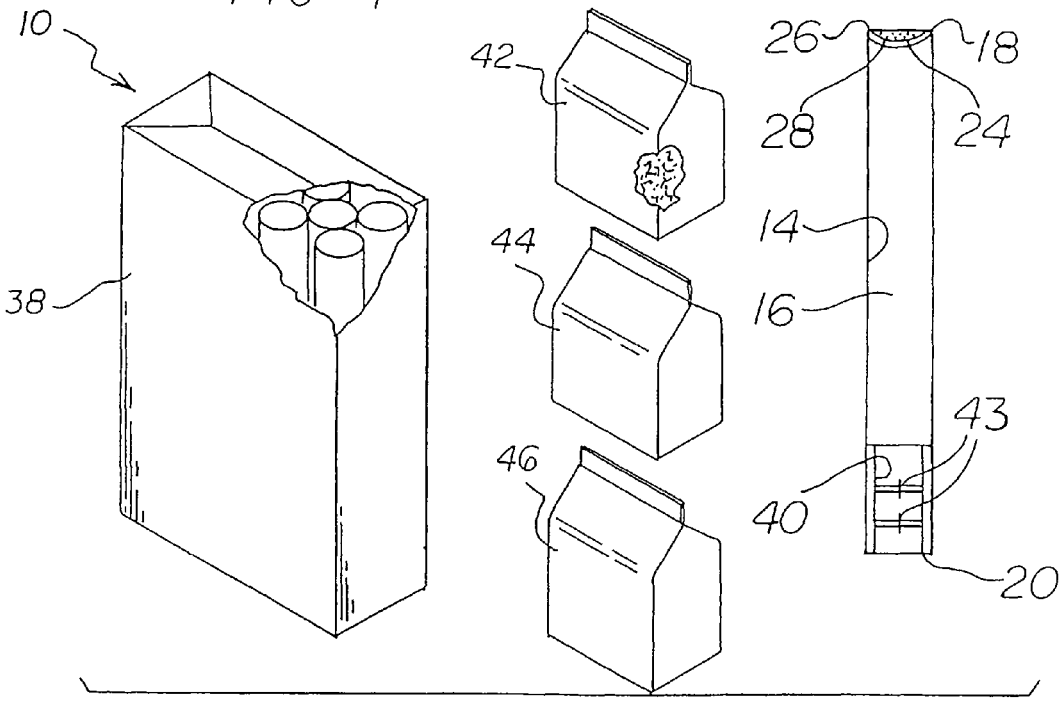
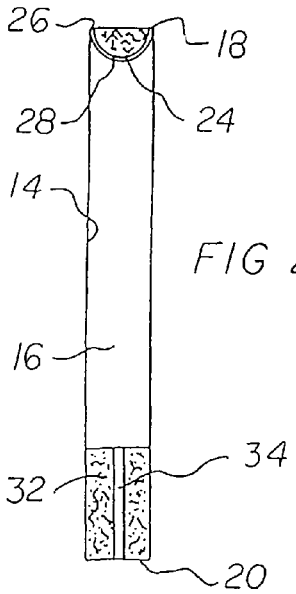
FIG 2
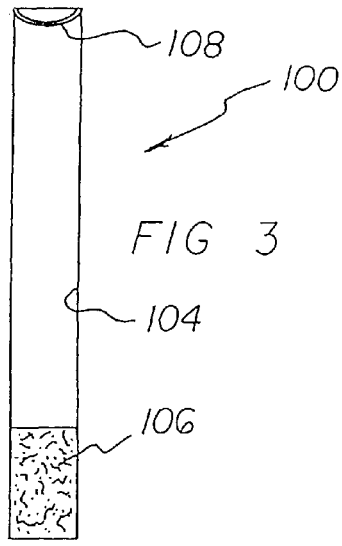
FIG 3

FIG 4
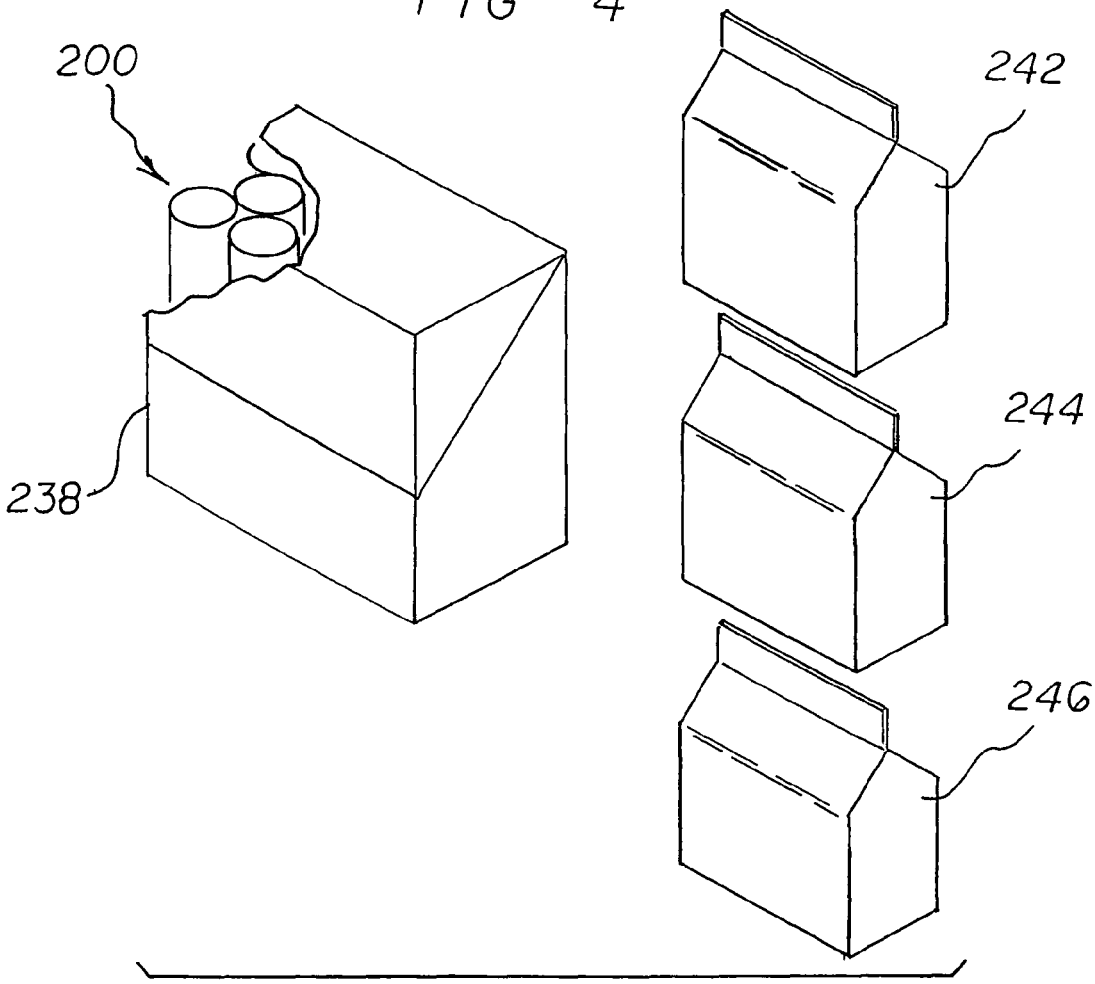
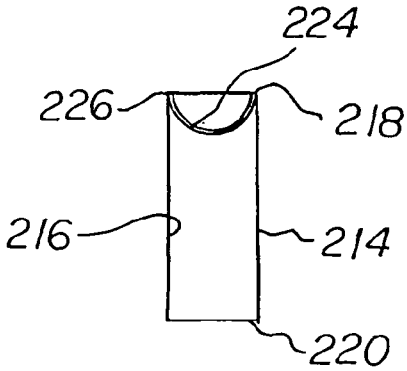
FIG 5
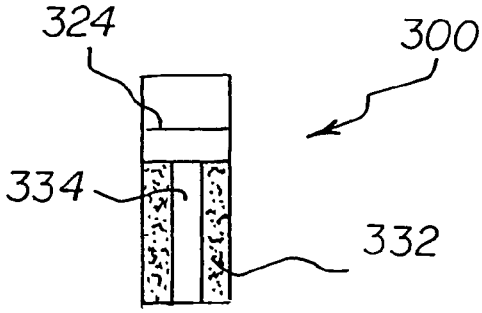
FIG 6

ONE SHOT CIGARETTE SYSTEM

BACKGROUND OF THE INVENTION

1. Field of the Invention

The present invention relates to a one shot cigarette system and more particularly pertains to smoking short quick cigarettes with any one of a plurality of burnable substances, the smoking being done in a safe, convenient, enjoyable and economical manner.

2. Description of the Prior Art

The use of smoking systems of known designs and configurations is known in the prior art. More specifically, smoking systems of known designs and configurations previously devised and utilized for the purpose of smoking through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,903,714 issued Feb. 27, 1990 to Barnes relates to a Smoking Article with Improved Mouthend Piece. U.S. Pat. No. 4,984,588 issued Jan. 15, 1991 to Stewart relates to a Low Delivery Cigarette. U.S. Pat. No. 6,883,523 issued Apr. 26, 2005 relates to a Cigarette having Porous Heat Transfer Tube.

While these devices fulfill their respective, particular objectives and requirements, the aforementioned patents do not describe a one shot cigarette system that allows for smoking short quick cigarettes with any one of a plurality of burnable substances, the smoking being done in a safe, convenient, enjoyable and economical manner.

In this respect, the one shot cigarette system according to the present invention substantially departs from the conventional concepts and designs of the prior art, and in doing so provides an apparatus primarily developed for the purpose of smoking short quick cigarettes with any one of a plurality of burnable substances, the smoking being done in a safe, convenient, enjoyable and economical manner.

Therefore, it can be appreciated that there exists a continuing need for a new and improved one shot cigarette system which can be used for smoking short quick cigarettes with any one of a plurality of burnable substances, the smoking being done in a safe, convenient, enjoyable and economical manner. In this regard, the present invention substantially fulfills this need.

SUMMARY OF THE INVENTION

In view of the foregoing disadvantages inherent in the known types of smoking systems of known designs and configurations now present in the prior art, the present invention provides an improved one shot cigarette system. As such, the general purpose of the present invention, which will be described subsequently in greater detail, is to provide a new and improved one shot cigarette system and method which has all the advantages of the prior art and none of the disadvantages.

To attain this, the present invention essentially comprises a one shot cigarette system. First provided is a wrapper. The wrapper is fabricated of a flexible, burnable, biodegradable paper material. The wrapper is shaped into a cylindrical configuration. The wrapper has a circular cross sectional configuration along its entire length. The wrapper has a central axis. The wrapper forms a major chamber. The major chamber has a front end. The major chamber has a rear end. The front and rear ends are spaced by a length of about 120 mm. The major chamber has a diameter of about 10 mm. The major chamber has a major volume of about 9400 cubic mm.

A miniature bowl is provided. The bowl is fabricated of a flexible, burnable, biodegradable cellulose material. The bowl is shaped in a generally hemispherical configuration. The bowl has an equatorial peripheral edge. The bowl is attached to the wrapper at the front end. The bowl has a pole. The pole is provided interiorly of the wrapper. The bowl is open at the front end of the major chamber. In this manner a minor chamber is formed. The bowl is adapted to receive a smokable substance. The minor chamber has a minor volume. The minor volume is between 2 percent and 10 percent of the major volume.

Provided next is a hollow tube within the wrapper. The tube has an exterior surface in contact with the wrapper adjacent to the rear end. The tube has an interior surface for the passage of smoke from the bowl to a smoker. The tube has an axis coincident with the axis of the wrapper. The tube is preferably fabricated of a relatively rigid plastic material.

In association with the hollow tube is a plurality of radial spokes 43 within the tube. The spokes have interior ends joining at a common point along the axis of the tube. The spokes have exterior ends coupled to the interior surface of the tube. The spokes are at equal angular spacings around their interior ends of the spokes. The spokes are fabricated of a relatively rigid plastic material. The rigidity of the wrapper provided by the tube and spokes prevents deformation of the wrapper while packaged and when the wrapper is held in the lips of a smoker.

Further provided is a container. The container is fabricated of a moderately rigid material. The container has a rectilinear configuration. The container removably receives a plurality of wrappers.

Provided last is a plurality of packages. Each of the packages contains a quantity of a different smoking substance. Typical smoking substances include mentholated tobacco, non-mentholated tobacco and miscellaneous herbs. The packages are adapted to be inserted into the bowl of one of the wrappers for smoking by a smoker. Any plurality of the smoking substances is adapted to be mixed together and inserted into the bowl of one of the wrappers for smoking by the smoker.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved one shot cigarette system which has all of the advantages of the prior art smoking systems of known designs and configurations and none of the disadvantages.

It is another object of the present invention to provide a new and improved one shot cigarette system which may be easily and efficiently manufactured and marketed.

It is further object of the present invention to provide a new and improved one shot cigarette system which is of durable and reliable constructions.

An even further object of the present invention is to provide a new and improved one shot cigarette system which is susceptible of a low cost of manufacture with regard to both materials and labor, and which accordingly is then susceptible of low prices of sale to the consuming public, thereby making such one shot cigarette system economically available to the buying public.

Even still another object of the present invention is to provide a one shot cigarette system for smoking short quick cigarettes with any one of a plurality of burnable substances, the smoking being done in a safe, convenient, enjoyable and economical manner.

Lastly, it is an object of the present invention to provide a new and improved one shot cigarette system. A wrapper is fabricated of a biodegradable burnable material. The wrapper is in a generally cylindrical configuration. The wrapper has front and rear ends. In this manner a major chamber is formed. A bowl is fabricated of a biodegradable burnable material. The bowl has a peripheral edge. The bowl is attached to the wrapper adjacent to the front end of the wrapper. The bowl forms a minor chamber within the major chamber. The bowl extends interiorly of the wrapper. A quantity of smokable material is inserted into the bowl. In this manner the smokable material is lit and smoked.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a one shot cigarette system constructed in accordance with the principles of the present invention.

FIG. 2 is a cross sectional view through the cigarette of FIG. 1.

FIG. 3 is a cross sectional view through a cigarette constructed in accordance with an alternate embodiment of the invention.

FIG. 4 is a perspective illustration of a one shot cigarette system constructed in accordance with another alternate embodiment of the invention.

FIG. 5 is a cross sectional view through the cigarette of FIG. 4.

FIG. 6 is a cross sectional view through a cigarette constructed in accordance with a final alternate embodiment of the invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved one shot cigarette system embodying the principles and concepts of the present invention and generally designated by the reference numeral 10 will be described.

The present invention, the one shot cigarette system 10 is comprised of a plurality of components. Such components in their broadest context include a wrapper, a bowl and a quantity of smokable material. Such components are individually configured and correlated with respect to each other so as to attain the desired objective.

First provided is a wrapper 14. The wrapper is fabricated of a flexible, burnable, biodegradable paper material. The wrapper is shaped into a cylindrical configuration. The wrapper has a circular cross sectional configuration along its entire length. The wrapper has a central axis. The wrapper forms a major chamber 16. The major chamber has a front end 18. The major chamber has a rear end 20. The front and rear ends are spaced by a length of about 120 mm. The major chamber has a diameter of about 10 mm. The major chamber has a major volume of about 9400 cubic mm.

A miniature bowl 24 is provided. The bowl is fabricated of a flexible, burnable, biodegradable cellulose material. The bowl is shaped in a generally hemispherical configuration. The bowl has an equatorial peripheral edge 26. The bowl is attached to the wrapper at the front end. The bowl has a pole 28. The pole is provided interiorly of the wrapper. The bowl is open at the front end of the major chamber. In this manner a minor chamber is formed. The bowl is adapted to receive a smokable substance. The minor chamber has a minor volume. The minor volume is between 2 percent and 10 percent of the major volume.

Provided next is a hollow tube 40 within the wrapper. The tube has an exterior surface in contact with the wrapper adjacent to the rear end. The tube has an interior surface for the passage of smoke from the bowl to a smoker. The tube has an axis coincident with the axis of the wrapper. The tube is preferably fabricated of a relatively rigid plastic material.

In association with the hollow tube is a plurality of radial spokes 43 within the tube. The spokes have interior ends joining at a common point along the axis of the tube. The spokes have exterior ends coupled to the interior surface of the tube. The spokes are at equal angular spacings around their interior ends of the spokes. The spokes are fabricated of a relatively rigid plastic material. The rigidity of the wrapper provided by the tube and spokes prevents deformation of the wrapper while packaged and when the wrapper is held in the lips of a smoker.

Further provided is a container 38. The container is fabricated of a moderately rigid material. The container has a rectilinear configuration. The container removably receives a plurality of wrappers.

Provided last is a plurality of packages 42, 44, 46. Each of the packages contains a quantity of a different smoking substance. Typical smoking substances include mentholated tobacco, non-mentholated tobacco and miscellaneous herbs. The packages are adapted to be inserted into the bowl of one of the wrappers for smoking by a smoker. Any plurality of the smoking substances is adapted to be mixed together and inserted into the bowl of one of the wrappers for smoking by the smoker.

A variation of the primary embodiment involves the use of a filter 32 in place of the tube and spokes. The filter is fabricated of a biodegradable porous material. In this manner smoke may pass there through. The filter is shaped in a generally cylindrical configuration. The filter has an interior end. The interior end is coupled to the wrapper at the rear end of the major chamber. The filter has an exterior end. The exterior end is provided interiorly of and in contact with the wrapper. The filter has a slender cylindrical opening 34 there through. The cylindrical opening has an axis. The axis of the cylindrical opening is coaxial with the axis of the wrapper. In this manner the passage of the smoke through the filter is accelerated. The filter is adapted to provide rigidity to the wrapper while packaged and during smoking.

An alternate embodiment 100 of the present invention is provided. The alternate embodiment includes a wrapper 104. The wrapper has a generally oval cross sectional configuration. A bowl 108 is provided. The bowl is of an ovate configuration. A filter 106 is provided. The filter is imperforate, without a central opening. The filter is fabricated of a biodegradable porous material. In this manner smoke may pass there through. The filter has a generally ovate configuration.

Another alternate embodiment 200 of the present invention is provided 200. The alternate embodiment includes a wrapper 214. The wrapper is fabricated of a flexible, burnable, biodegradable paper material. The wrapper is shaped into a cylindrical configuration. The wrapper has circular cross sectional configuration along its entire length. The wrapper has a central axis. The wrapper forms a major chamber 216. The major chamber has a front end 218. The wrapper has a rear end 220. The front and rear ends are spaced by a length of about 70 mm. The major chamber has a diameter of about 10 mm. The major chamber has a major volume of about 5500 cubic mm.

A miniature bowl 224 is provided. The bowl is fabricated of a flexible, burnable, biodegradable cellulose material. The bowl has an equatorial peripheral edge 226. The bowl is attached to the wrapper adjacent to the front end. The bowl extends interiorly of the wrapper. The bowl is open at the front end of the wrapper. In this manner a minor chamber is formed. The bowl is adapted to receive a smokable substance. The minor chamber has a minor volume. The minor volume is between 3 percent and 20 percent of the major volume.

The wrapper is fabricated of a relatively rigid material. Or, in the alternative, conventional wrapper paper could be used with double thickness. In this manner beam strength is provided. Further in this manner collapsing of the wrapper during use of the system is abated.

Provided next is a container 238. The container is fabricated of a moderately rigid material. The container has a rectilinear configuration. The container removably receives a plurality of the wrappers. Each wrapper has a bowl and a filter.

Provided last is a plurality of packages 242, 244, 246. Each of the packages contains a quantity of a different smoking substance. Typical smoking substances include non-mentholated tobacco, mentholated tobacco and other herbs. Any one of the smoking substances is adapted to be inserted into the bowl of one of the wrappers for smoking by a smoker. Any plurality of the smoking substances is further adapted to be mixed together and inserted into the bowl of one of the wrappers for smoking by the smoker.

A further alternate embodiment 300 of the present invention is provided. The alternate embodiment includes a bowl 324. The bowl is fabricated in a circular configuration. In this manner a cylindrically shaped minor chamber is created. A filter 332 is provided. The filter is fabricated of a biodegradable porous material. In this manner smoke may pass there through. The filter is shaped in a generally cylindrical configuration. The filter has an interior end. The interior end is coupled to the wrapper adjacent to the front end of the major chamber. The filter has an exterior end. The exterior end is provided interiorly of and in contact with the bowl. The filter has an enlarged cylindrical opening 334 there through. The cylindrical opening has an axis. The axis of the cylindrical opening is coaxial with the axis of the wrapper. In this manner the passage of smoke through the filter is accelerated. The filter is adapted to provide rigidity to the wrapper while packaged and during smoking.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A one shot cigarette system for smoking short quick cigarettes with any one of a plurality of burnable substances, the smoking being done in a safe, convenient, enjoyable and economical manner, the system comprising, in combination:

a plurality of wrappers, each wrapper fabricated of a flexible, burnable, biodegradable paper material, each wrapper being shaped into a cylindrical configuration with a circular cross sectional configuration along its entire length, each wrapper having a central axis, each wrapper forming a major chamber having a front end and a rear end spaced by a length of about 120 mm, each major chamber having a diameter of about 10 mm and a major volume of about 9400 cubic mm;

a miniature bowl fabricated of a flexible, burnable, biodegradable cellulose material, each bowl being shaped in a generally hemispherical configuration, each bowl having an equatorial peripheral edge attached to an associated wrapper at the front end, each bowl having a pole interiorly of an associated wrapper, each bowl being open at the front end of the major chamber to form a minor chamber, each bowl adapted to receive a smokable substance, each minor chamber having a minor volume being between 2 percent and 10 percent of each major volume;

a hollow tube within each wrapper, each tube having an exterior surface in contact with each wrapper adjacent to an associated rear end, each hollow tube having an interior surface for the passage of smoke from the bowl to a smoker, each tube having an axis coincident with the axis of each wrapper, each tube being fabricated of a relatively rigid plastic material, each tube providing, rigidity to the wrapper;

a plurality of radial spokes within each tube, the spokes having interior ends joining at a common point along the axis of each tube, the spokes having exterior ends coupled to the interior surface of the tube, the spokes being at equal angular spacings around their interior ends, the spokes being fabricated of a relatively rigid plastic material, the spokes providing additional rigidity to each wrapper;

a container fabricated of a moderately rigid material, the container having a rectilinear configuration, the container removably receiving a plurality of wrappers; and a plurality of packages, each of the packages containing a quantity of a different smoking substance adapted to be inserted into the bowl of one of the wrappers for smoking by a smoker, any plurality of the smoking substances adapted to be mixed together and inserted into the bowl of one of the wrappers for smoking by the smoker.

* * * * *